US009076415B2

(12) United States Patent
Allen

(10) Patent No.: US 9,076,415 B2
(45) Date of Patent: Jul. 7, 2015

(54) MUSICAL PERCUSSION SUPPORT STANDS HAVING THREE SUPPORTING CONTACT POINTS AND RELATED SYSTEMS AND METHODS

(71) Applicant: Conn-Selmer, Inc., Elkhart, IN (US)

(72) Inventor: Joshua Allen, Portage, MI (US)

(73) Assignee: Conn-Selmer, Inc., Elkhart, IN (US)

( * ) Notice: Subject to any disclaimer, the term of this patent is extended or adjusted under 35 U.S.C. 154(b) by 0 days.

(21) Appl. No.: 14/355,073

(22) PCT Filed: Nov. 28, 2012

(86) PCT No.: PCT/US2012/066758

§ 371 (c)(1),
(2) Date: Apr. 29, 2014

(87) PCT Pub. No.: WO2013/082085

PCT Pub. Date: Jun. 6, 2013

(65) Prior Publication Data

US 2014/0298972 A1 Oct. 9, 2014

Related U.S. Application Data

(60) Provisional application No. 61/727,153, filed on Nov. 16, 2012, provisional application No. 61/564,897, filed on Nov. 30, 2011.

(51) Int. Cl.

| | |
|---|---|
| ***G10D 13/02*** | (2006.01) |
| ***G10G 5/00*** | (2006.01) |
| ***G10D 13/06*** | (2006.01) |

(52) U.S. Cl.
CPC ..... *G10G 5/005* (2013.01); *G10D 13/026* (2013.01); *G10D 13/065* (2013.01)

(58) Field of Classification Search
USPC ..... 84/422.3
See application file for complete search history.

(56) References Cited

U.S. PATENT DOCUMENTS

| | | | | |
|---|---|---|---|---|
| 4,381,690 | A * | 5/1983 | Kimble | 84/422.3 |
| 4,488,471 | A * | 12/1984 | Youakim | 84/422.3 |
| 5,018,426 | A | 5/1991 | Suzuki | |
| 5,945,616 | A | 8/1999 | Hoshino | |
| 6,020,548 | A * | 2/2000 | Kurosaki | 84/421 |
| 6,329,584 | B1 * | 12/2001 | Liao | 84/422.3 |
| 6,437,225 | B1 | 8/2002 | Shigenaga | |
| 6,528,714 | B1 | 3/2003 | Liao | |

OTHER PUBLICATIONS

International Search Report; PCT/US2012/066758; Feb. 7, 2013; 2 pp.
Written Opinion; PCT/US2012/066758; Feb. 7, 2013; 4 pp.

* cited by examiner

*Primary Examiner* — Christopher Uhlir
(74) *Attorney, Agent, or Firm* — Fish & Richardson P.C.

(57) ABSTRACT

In some aspects, a hi-hat musical cymbal set support stand includes a vertical stand tube defining a stand axis, and three support members associated with a lower end of the stand tube and disposed in a tripod arrangement for supporting engagement of the stand upon a supporting surface. Each supporting member defines a contact point with the supporting surface, and the three supporting members supporting the lower end of the stand tube in a position spaced apart from the supporting floor surface. At least one of the three supporting members includes a foot pedal cymbal operating device having an outward heel end defining one of the three contact points and an inward toe end suspended from the lower end of the stand tube, the heel end being disposed in engagement with the supporting surface, and the toe end being spaced from contact with the supporting surface.

8 Claims, 13 Drawing Sheets

MUSICAL PERCUSSION SUPPORT STANDS HAVING THREE SUPPORTING CONTACT POINTS AND RELATED SYSTEMS AND METHODS

CROSS-REFERENCE TO RELATED APPLICATIONS

This application is a U.S. National Phase Application of International Patent Application No. PCT/US2012/066758 filed Nov. 28, 2012, which claims the benefit of U.S. Provisional Patent Application No. 61/564,897, filed Nov. 30, 2011, and U.S. Provisional Patent Application No. 61/727,153, filed Nov. 16, 2012, the contents of all of which are incorporated by reference herein in their entirety.

TECHNICAL FIELD

This disclosure relates to musical percussion support stands having three supporting contact points and to related systems and methods.

BACKGROUND

Certain musical cymbal arrangements (e.g., hi-hat cymbals) include two, cooperating cymbals (e.g., an upper cymbal and a lower cymbal) that, using a mechanical foot pedal, are brought together to produce sound. The mechanical foot pedal is typically mechanically connected to at least one of the cooperating cymbals (e.g., the upper cymbal) and is operated by depressing (e.g., stepping on) the foot pedal to move the upper cymbal towards the lower cymbal. To support such musical cymbal arrangements, cymbal support stands typically have multiple (e.g., three or more) supporting members.

SUMMARY

In some aspects of the disclosure, a hi-hat musical cymbal set support stand includes a vertical stand tube defining a stand axis, and three support members associated with a lower end of the stand tube and disposed in a tripod arrangement for supporting engagement of the stand upon a supporting surface. Each supporting member defines a contact point with the supporting surface and the three supporting members support the lower end of the stand tube in a position spaced apart from the supporting floor surface. At least one of the three supporting members includes a foot pedal cymbal operating device having an outward heel end defining one of the three contact points and an inward toe end suspended from the lower end of the stand tube, the heel end being disposed in engagement with the supporting surface, and the toe end being spaced from contact with the supporting surface.

Implementations can include one or more of the following features.

In some implementations, two of the supporting members are leg members, the leg members being collapsible between a first, support position and a second, stored position, lying closely adjacent to the stand tube.

The support stand can include a cleat associated with the heel end that defines a gripping surface extending downward from the heel end for engagement upon the supporting surface, the cleat being rotatable between a first, deployed position, with the gripping surface in engagement with supporting surface, and a second, stowed position where the cleat is removed from engagement upon the supporting surface.

In some implementations, the foot pedal cymbal operating device is pivotable in a plane transverse to the supporting floor surface between a first, extended, stand support position and a second, compact position, lying closely adjacent to the stand tube.

In some implementations, the foot pedal cymbal operating device includes a securement element operable to secure the foot pedal cymbal operating device in the first, extended stand support position.

In some implementations, the three contact points define a stand contact plane, and the heel end contact point is spaced from the stand axis by a distance that is at least 9 inches (22.9 cm) along the stand contact plane.

Implementations can have one or more of the following advantages.

The musical cymbal support stands described herein can support musical cymbal arrangements (e.g., hi-hat musical cymbals) in a stable manner, e.g., as compared to certain conventional hi-hat cymbal support stands. Increased stability is achieved by providing three points of contact along a supporting floor surface, with only a heel portion of the pedal operating device contacting the floor surface.

The details of one or more implementations are set forth in the accompanying drawings and the description below. Other aspects, features, and advantages will be apparent from the description and drawings, and from the claims.

DETAILED DESCRIPTION

Figure 1:
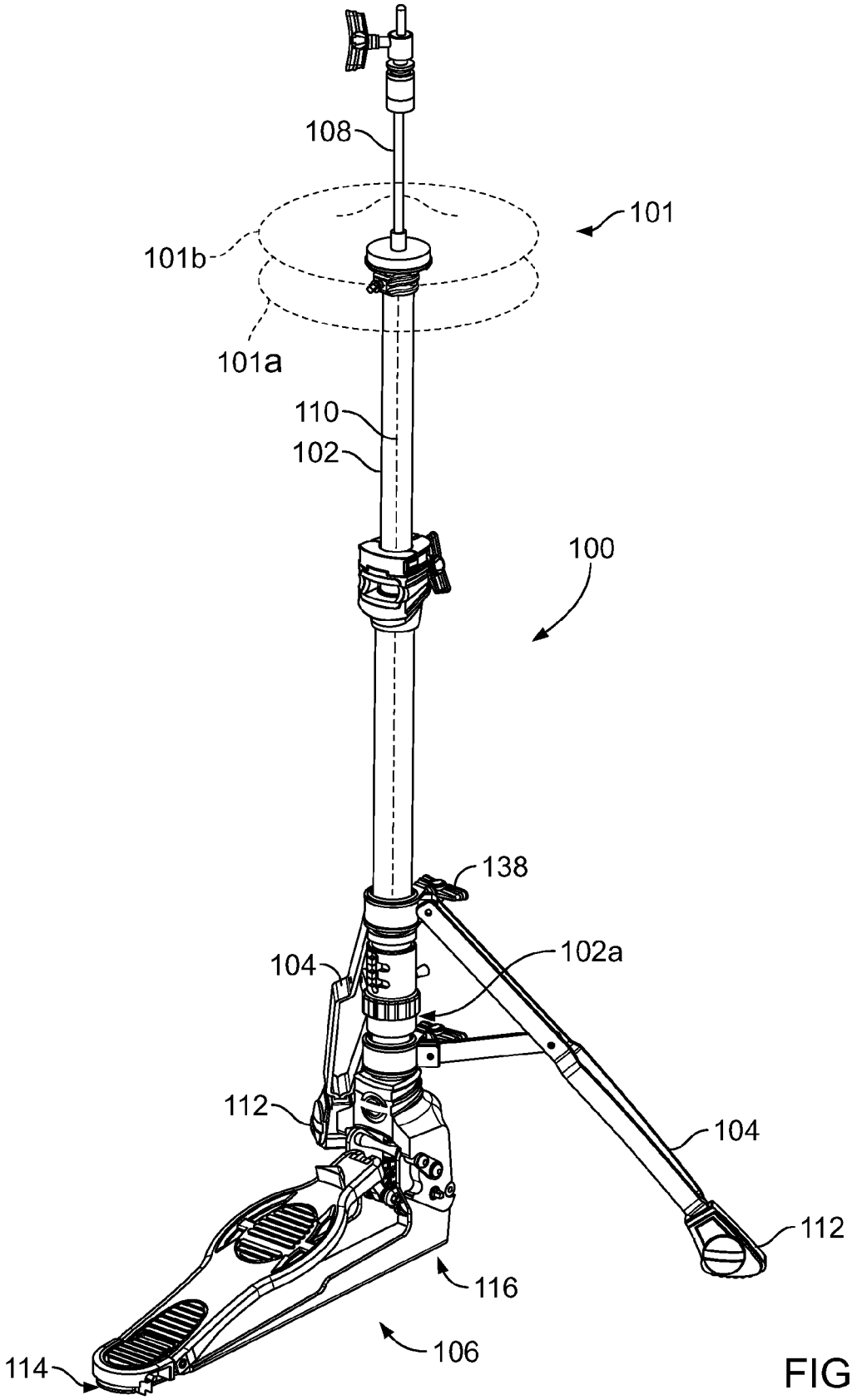
FIG. 1 is a perspective view of a hi-hat musical cymbal set support stand of the disclosure.

Referring to FIG. 1, a musical cymbal support stand 100 of the disclosure (e.g., a hi-hat cymbal stand) using three points of contact (i.e., two supporting leg members and a heel end of a cymbal operating foot pedal) provides increased stability to the support stand. The hi-hat musical cymbal set support stand 100 for supporting a hi-hat musical cymbal set 101 includes a vertical stand tube 102 and three collapsible support members associated with a lower end 102*a* of the stand tube 102 and disposed in a tripod arrangement for supporting engagement of the stand 100 upon a supporting surface. As shown, the three support members include two leg members 104 and a foot pedal cymbal operating device 106. Each support member defines a contact point with the supporting surface. As discussed below, the three contact points are typically defined by end regions of the legs 104 and a heel region of the foot pedal cymbal operating device 106.

The stand tube 102 is a generally round, hollow tube having a length of about 19 inches (48.3 cm) to about 34 inches (86.4 cm) (e.g., adjustable between 20 inches and 32 inches (50.8 cm and 81.3 cm)) and an outer diameter of about 0.875 inch (22.2 mm) to about 1.375 inches (34.9 mm) (e.g., 1.25 inches (31.8 mm)). The stand tube 102 has an inner diameter sized for passage of a vertical rod 108 that is used for mounting and moving (i.e., lifting and dropping by operation of the foot pedal 106) of an upper cymbal 101*b* of the hi-hat cymbal set 101 during a performance. In some implementations, the inner diameter is about 1 inch (25.4 mm) to about 1.25 inches (31.8 mm) (e.g., 1.125 inches (28.6 mm)). The stand tube defines a generally vertical stand axis 110 along which the vertical rod 108 moves during use.

The three support members (e.g., the two leg members 104 and the outer (heel) end only of the foot pedal cymbal operating device 106) support the lower end 102*a* of the stand tube 102 so that the lower end 102*a* is spaced apart from the supporting floor surface.

The leg members (e.g., legs 104) are about 14 inches (35.6 cm) to about 18 inches (45.7 cm) (e.g., 16.5 inches (41.9 cm)) in length and are collapsible from a first, support position to a second, stored position, lying closely adjacent to the stand tube 102. In the first, support position, the legs 104 extend outwardly away from the stand tube 102 for supporting the support stand 100. When deployed in a tripod configuration, they create a support foot print having a diameter of about 20 inches (50.8 cm) to about 28 inches (71.1 cm) (e.g., 24 inches (61.0 cm)) about the vertical axis 110.

Foot elements 112, e.g., made of soft rubber or plastic, are disposed near the end of each leg 104 to support the musical instrument support stand 100 upon a supporting floor surface in a non-skid manner.

Figure 2:
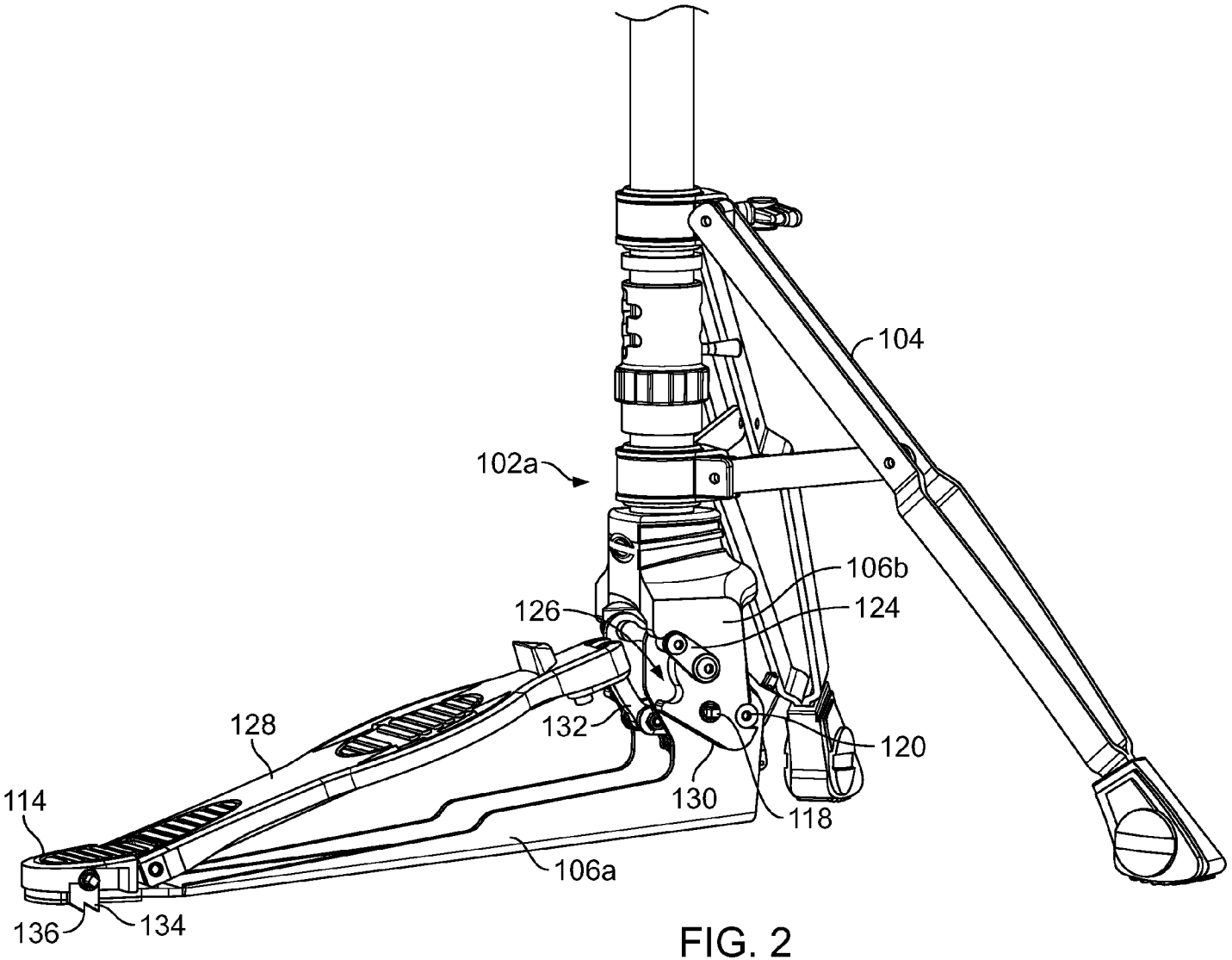
FIG. 2 is a perspective view of the lower portion of FIG. 1 showing components of the foot pedal cymbal operating device.

The foot pedal cymbal operating device 106 has an outward heel end 114 defining one of the three contact points and an inward toe end 116 suspended from the lower end 102*a* of the stand tube. Referring to FIGS. 2 and 3, during use, only the heel end 114 is disposed in engagement with the supporting floor surface, while the toe end 116 is spaced from contact with the supporting floor surface. In some implementations, the toe end 116 has a spacing (i.e., height) of about 0.5 inch (12.7 mm) to about 1.5 inches (38.1 mm) from the supporting floor surface. The heel end 114 has a spacing from the stand axis 110 that is about 12 inches (30.5 cm) to about 16 inches (40.6 cm) (e.g., 14 inches (35.6 cm)).

As discussed in more detail below, for transportation and/or storage, the foot pedal cymbal operating device 106 is pivotable in a plane transverse to the supporting floor surface between a first, extended, stand support position (shown in FIGS. 1 and 2) and a second, compact position, lying closely adjacent to the stand tube 102 (shown in FIG. 3C).

By arranging the foot pedal cymbal operating device 106 so that only the heel end 114 is disposed for contact with the supporting floor surface, a tripod-like arrangement is created to support the stand tube 102. As a result, the stand 100 can be relatively more stable during use, including when a user depresses the foot pedal.

Referring to FIG. 2, the foot pedal cymbal operating device 106 includes a moving pedal 128 operated to turn a rotor 130 that is pivotally fixed about a post 120 to a moving portion 106*a* of the foot pedal cymbal operating device 106. The moving pedal 128 is connected to the rotor 130 by a lever 132 so that when the moving pedal 128 is depressed (e.g., stepped on by a user), the rotor 130 rotates about the post 120. The rotor 130 is connected (e.g., by a chain or a strap) to the vertically moving rod 108 so that as the rotor 130 rotates, the vertically moving rod 108 moves the upper cymbal 101*b* to contact the lower cymbal 101*a* and generate sound.

Figure 3A:
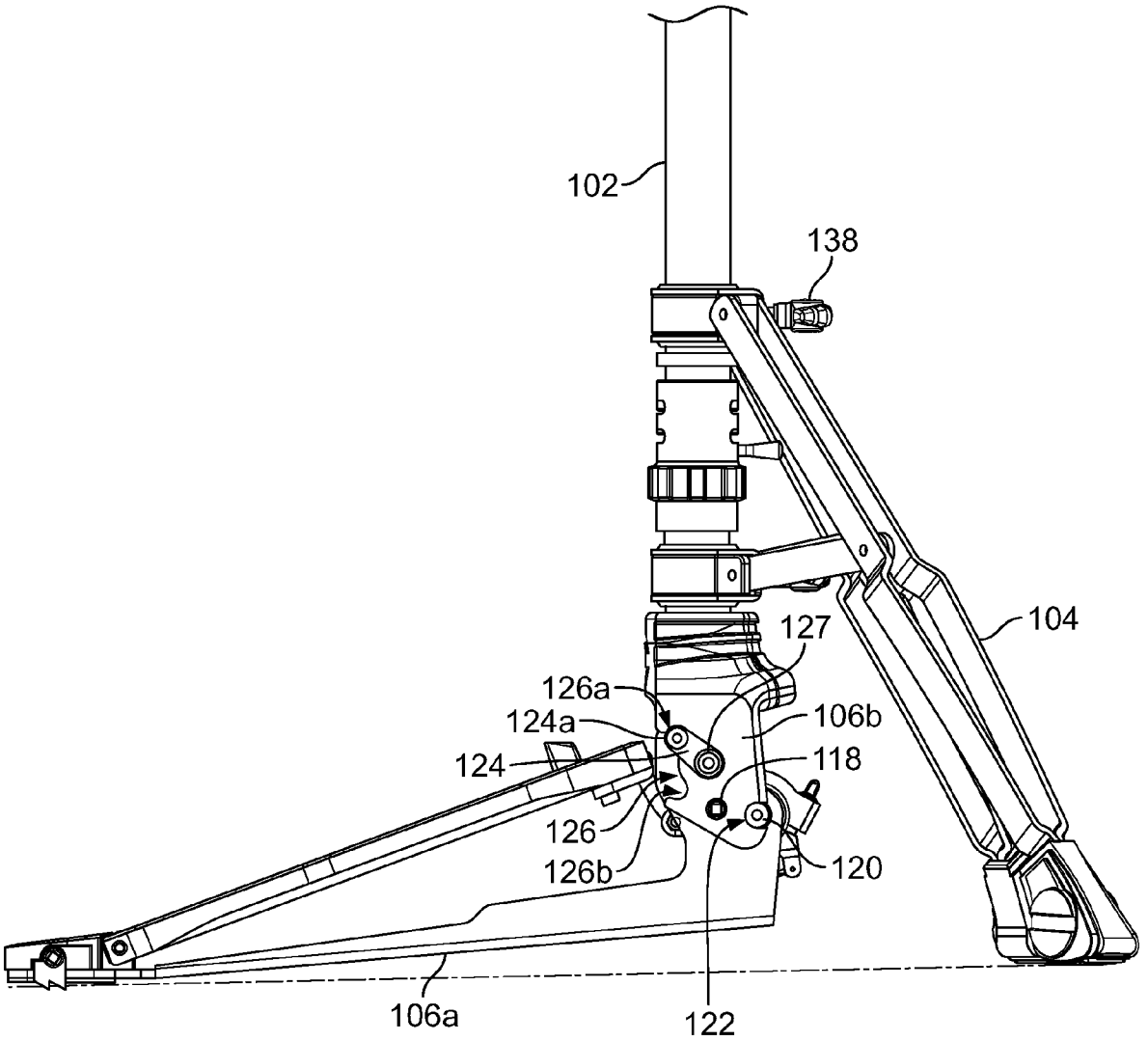
FIGS. 3A-3C are sequential side views showing the lower portion of FIGS. 1-2 collapsing to a compact unit.
Figure 3B:
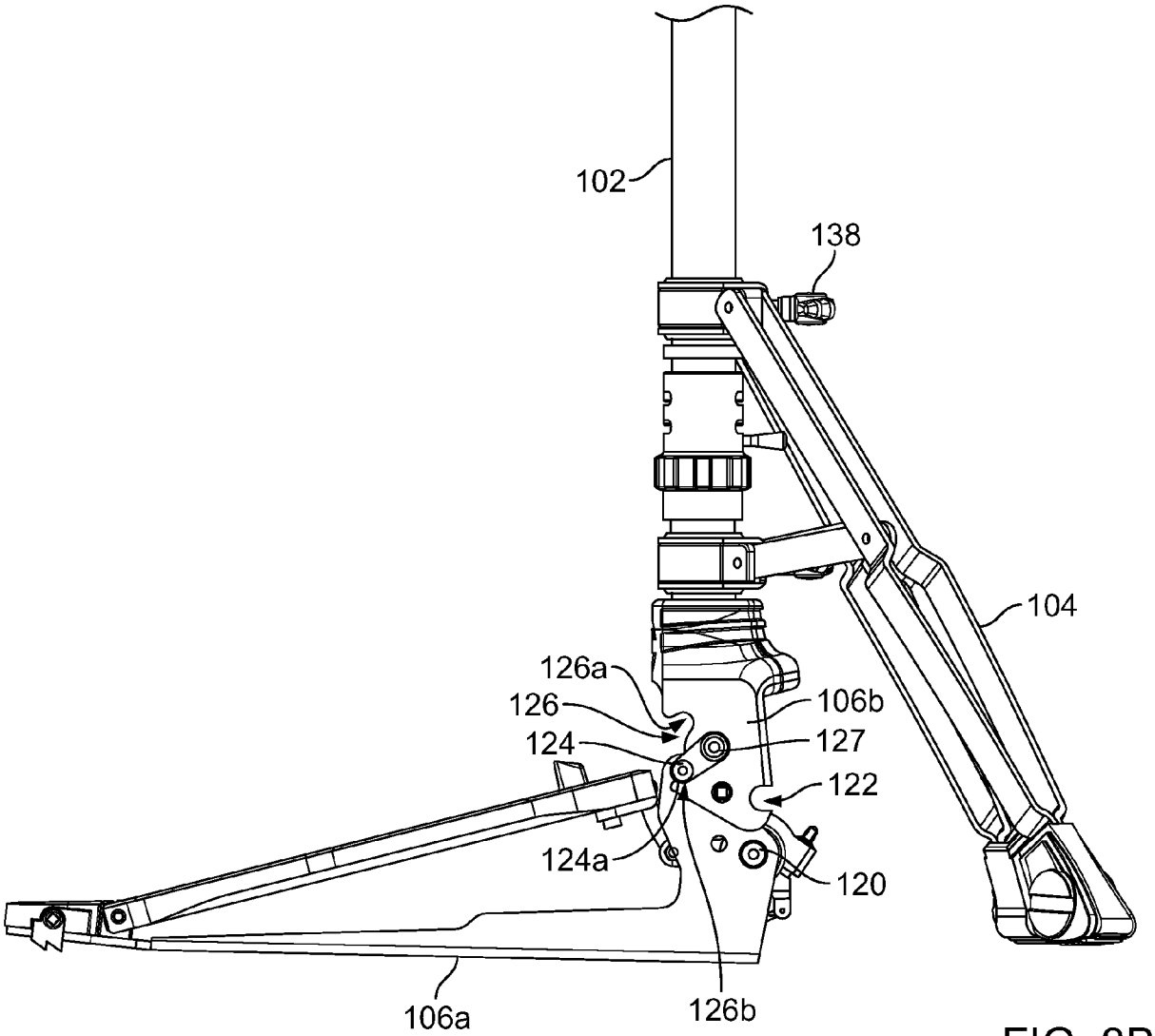
Figure 3C:
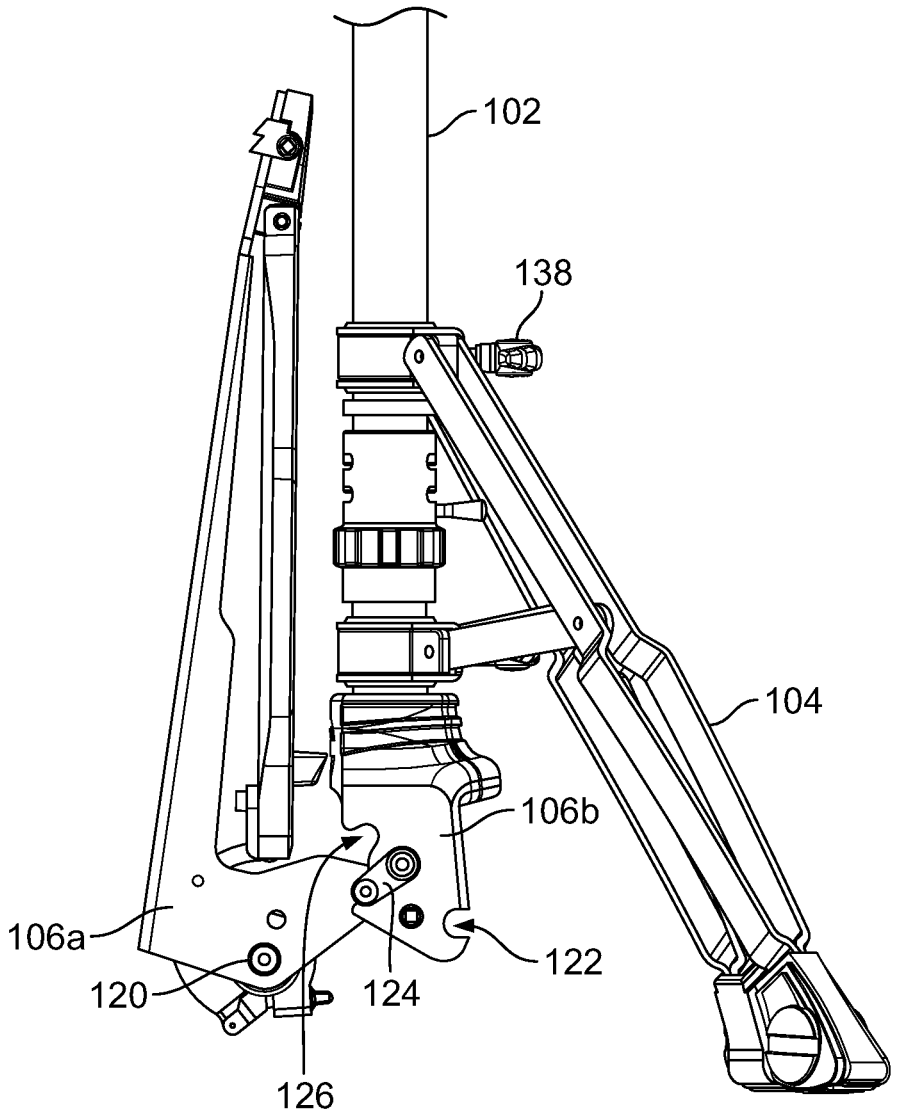
Figure 4:
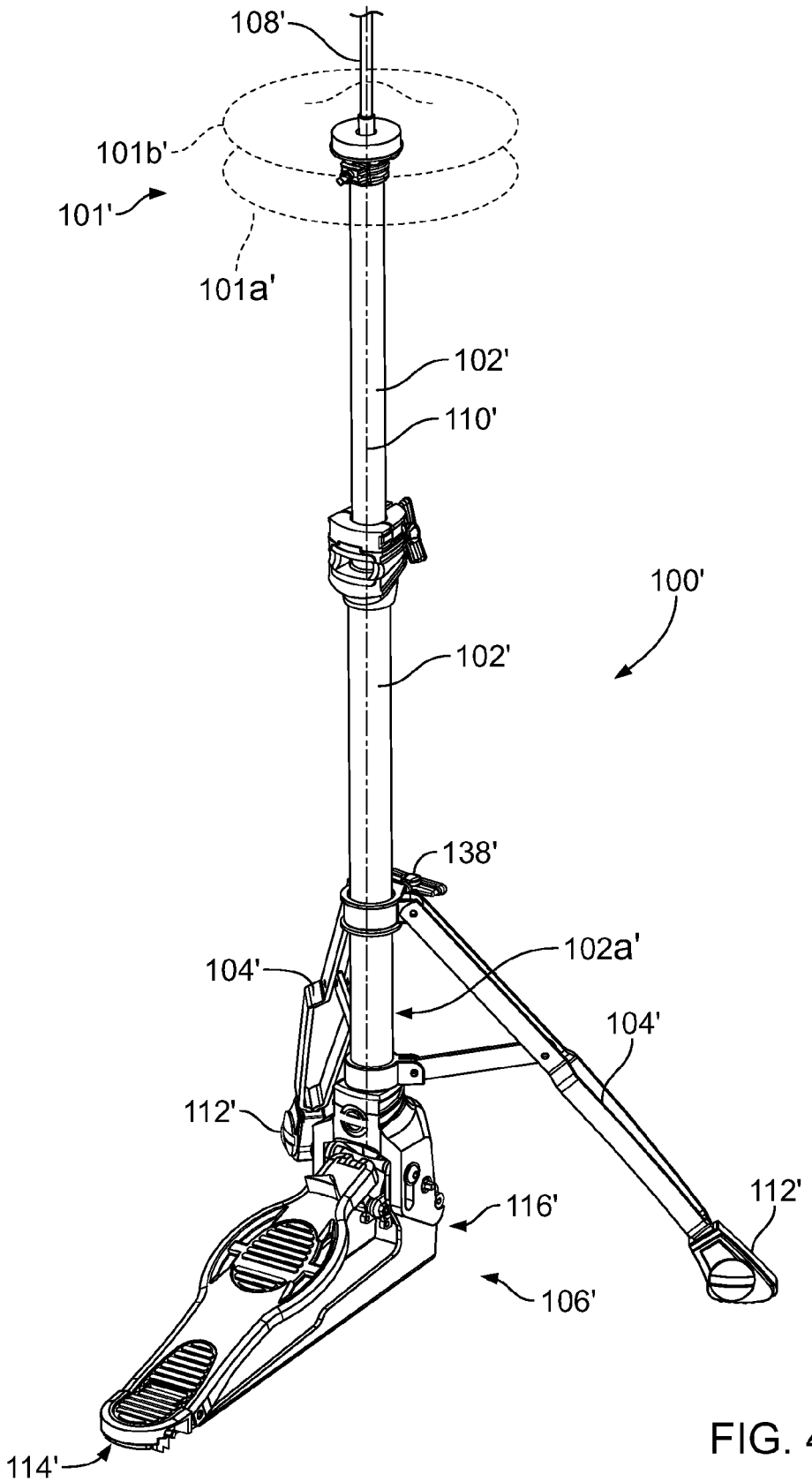
FIG. 4 is a perspective view of another hi-hat musical cymbal set support stand of the disclosure.

Referring to FIGS. 3A-3C, the legs 104 and the foot pedal cymbal operating device 106 are collapsible between extended support positions, where they form the supporting tripod arrangement, to compact stored positions to form a compact unit, e.g., for storage and/or transportation. The foot pedal cymbal operating device 106 includes one or more securement elements (e.g., fasteners) 118 that secure the foot pedal operating device 106 in a first, extended, stand support position by securing the moving portion 106*a* to a stationary portion 106*b*.

To collapse the foot pedal operating device 106 from the first, operating position to the second, compact position, the securement element 118 is removed (or displaced) and the moving portion 106*a* is first moved downwardly away from the stand tube 102 to dislodge an alignment post 120 of the moving portion 106*a* from a recess 122 of the stationary portion 106*b*. As the post 120 is dislodged from the recess 122, the entire moving portion 106*a* is moved downwardly while a pin 124 a which is part of lever 124 of the moving portion 106*a* rides in a corresponding notch 126 of the stationary portion 106*b*. Lever 124 rotates around pivot point 127 so that pin 124*a* moves from an initial position at 126*a* to a final position at 126*b*. The moving portion 106*a*, along with the attached moving pedal 128 and rotor 130, are then pivoted away from the stand tube 102 in order to provide clearance for the post 120 from the stationary portion 106*b* (referring to FIGS. 3A-3C).

Once the moving portion 106*a* is translated downward so that the post can sufficiently clear the stationary portion 106*b*, the moving portion 106*a* can be pivoted upwardly towards stand tube 102 to lie closely adjacent to the stand tube 102 in the second, compact position (referring to FIG. 3C).

To collapse the legs 104, a leg clamp 138 is released so that the legs 104 can pivot with respect to stand tube 102. The unsecured legs 104 can pivot towards the stand tube 102 as the leg clamp 138 moves upward along the stand tube 102. Once the legs 104 are positioned closely to the stand tube 102, the leg clamp 138 can be re-tightened to secure the legs 104 in the second, stored position to form a compact unit for storage or transport.

In some implementations, the foot pedal cymbal operating device 106 includes a cleat 134 associated with the heel end 114. The cleat 134 defines a gripping surface 136 that extends downwardly from the heel end 114 for engagement upon the supporting floor surface. The cleat 134 is rotatable between a first, deployed position, with the gripping surface in engagement with supporting surface (shown in FIG. 2), and a second, stowed position where the cleat 134 is removed from engagement upon the supporting floor surface. In some implementations, when in the second, stowed position, the cleat 134 is positioned within cavity of the heel end 114.

In another embodiment, referring to FIGS. 4-7E, a musical cymbal support stand 100' of the disclosure using three points of contact (i.e., two supporting leg members and a heel end of a cymbal operating foot pedal) provides increased stability to the support stand. The hi-hat musical cymbal set support stand 100' for supporting a hi-hat musical cymbal set 101' includes a vertical stand tube 102' and three collapsible support members associated with a lower end 102*a'* of the stand tube 102' and disposed in a tripod arrangement for supporting engagement of the stand 100' upon a supporting surface. As shown, the three support members include two leg members 104' and a foot pedal cymbal operating device 106'. Each support member defines a contact point with the supporting surface. Three contact points are typically defined by end regions of the legs 104' and a heel region of the foot pedal cymbal operating device 106'.

The stand tube 102' is a generally round, hollow tube having a length of about 19 inches (48.3 cm) to about 34 inches (86.4 cm) (e.g., adjustable between 20 inches and 32 inches (50.8 cm and 81.3 cm)) and an outer diameter of about 0.875 inch (22.2 mm) to about 1.375 inches (34.9 mm) (e.g., 1.25 inches (28.6 mm)). The stand tube 102' has an inner diameter sized for passage of a vertical rod 108 that is used for mounting and moving (i.e., lifting and dropping by operation of the foot pedal 106') of an upper cymbal 101*b'* of the hi-hat cymbal set 101' during a performance. In some implementations, the inner diameter is about 1 inch (25.4 mm) to about 1.25 inches (31.8 mm) (e.g., 1.125 inches (28.6 mm)). The stand tube defines a generally vertical stand axis 110' along which the vertical rod 108' moves during use.

The three support members (e.g., the two leg members 104' and the outer (heel) end only of the foot pedal cymbal operating device 106') support the lower end 102*a'* of the stand tube 102' so that the lower end 102*a'* is spaced apart from the supporting floor surface.

The leg members (e.g., legs 104') are about 14 inches (35.6 cm) to about 18 inches (45.7 cm) (e.g., 16.5 inches (41.9 cm)) in length and are collapsible from a first, support position to a second, stored position, lying closely adjacent to the stand tube 102'. In the first, support position, the legs 104' extend outwardly away from the stand tube 102' for supporting the support stand 100'. When deployed in a tripod configuration, they create a support foot print having a diameter of about 20 inches (50.8 cm) to about 28 inches (71.1 cm) (e.g., 24 inches (61 cm)) about the vertical axis 110'.

Foot elements 112', e.g., made of soft rubber or plastic, are disposed near the end of each leg 104' to support the musical instrument support stand 100' upon a supporting floor surface in a non-skid manner.

Figure 5:
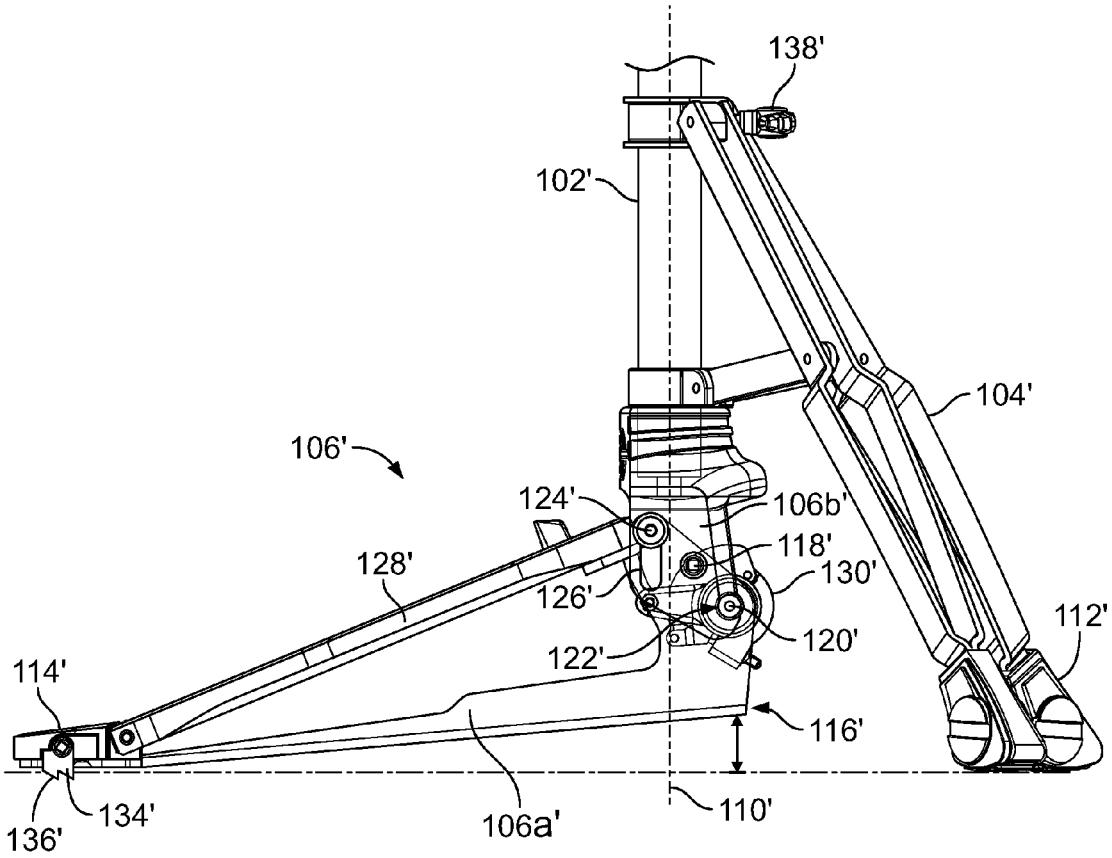
FIG. 5 is a side view of a lower portion of the musical cymbal set support stand of FIG. 4 shown with a foot pedal cymbal operating device shown semi-transparent.
Figure 6:
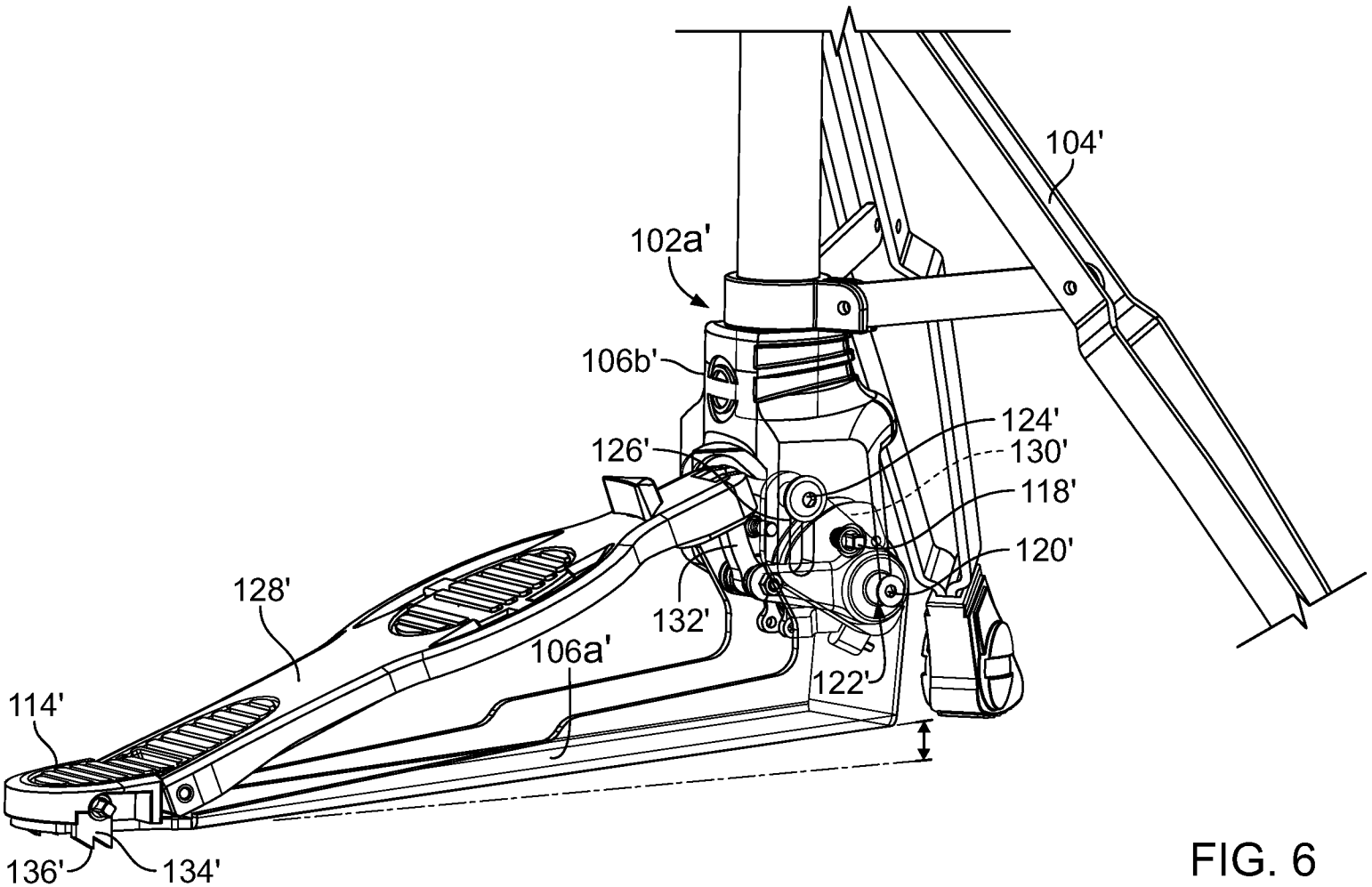
FIG. 6 is a perspective view of the lower portion of FIG. 5 with components of the foot pedal cymbal operating device shown semi-transparent.

The foot pedal cymbal operating device 106' has an outward heel end 114' defining one of the three contact points and an inward toe end 116' suspended from the lower end 102*a'* of the stand tube. Referring to FIGS. 5 and 6, during use, only the heel end 114' is disposed in engagement with the supporting floor surface, while the toe end 116' is spaced from contact with the supporting floor surface. In some implementations, the toe end 116' has a spacing (i.e., height) of about 0.5 inch (12.7 mm) to about 1.5 inches (38.1 mm) from the supporting floor surface. The heel end 114' is spaced from the stand axis 110' by about 12 inches (30.5 cm) to about 16 inches (40.6 cm) (e.g., 14 inches (35.6 cm)).

Figure 7A:
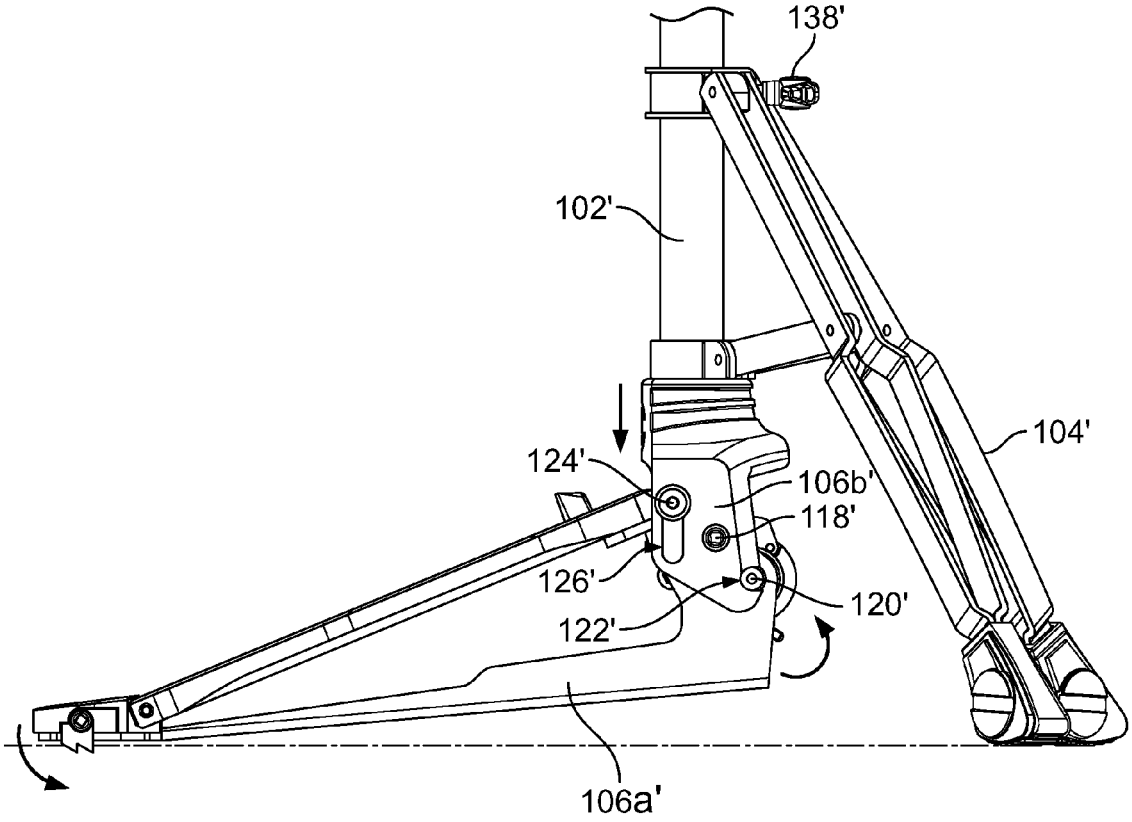
FIGS. 7A through 7E are sequential side views showing the lower portion of FIGS. 4-6 collapsing to a compact unit.
Figure 7B:
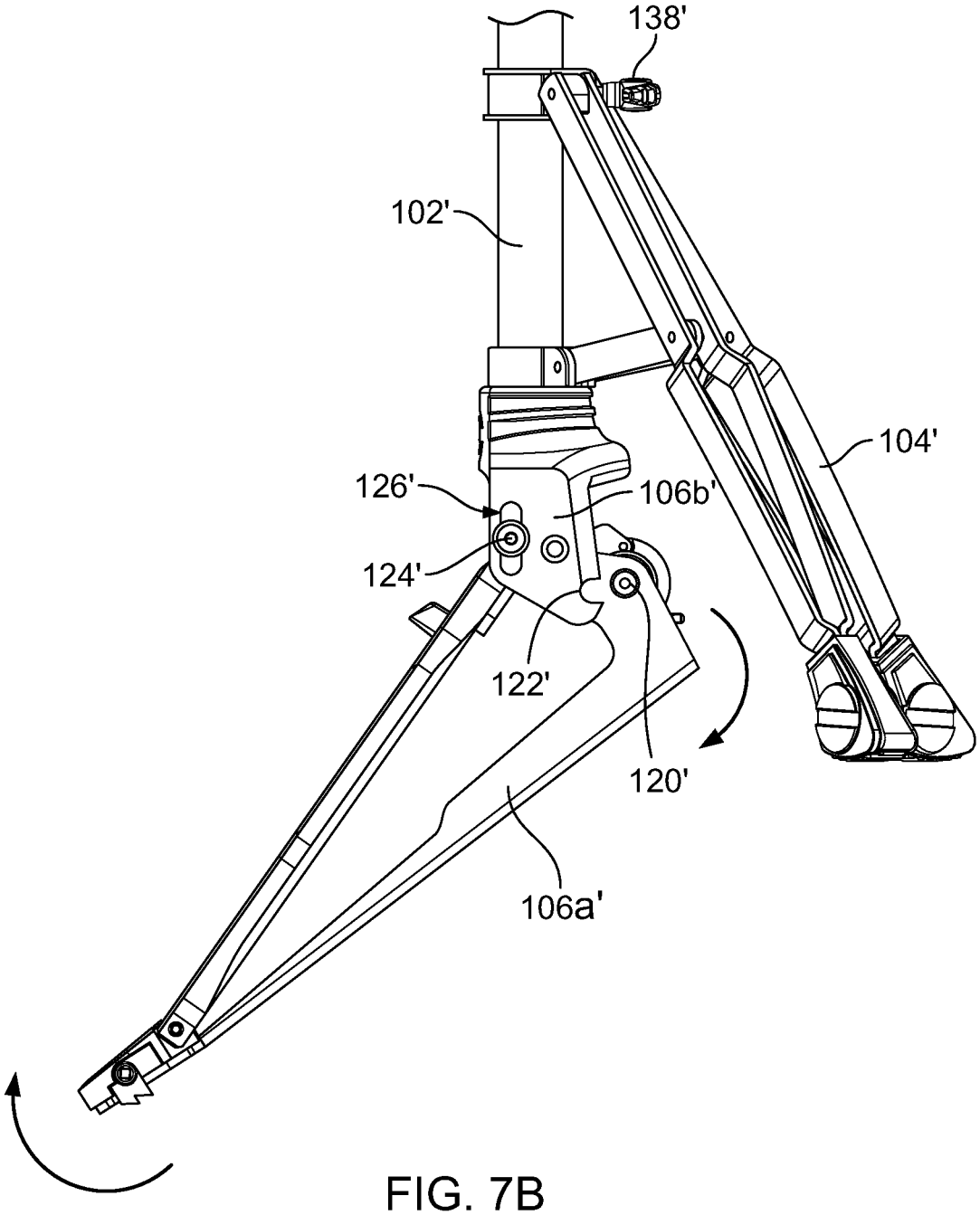
Figure 7C:
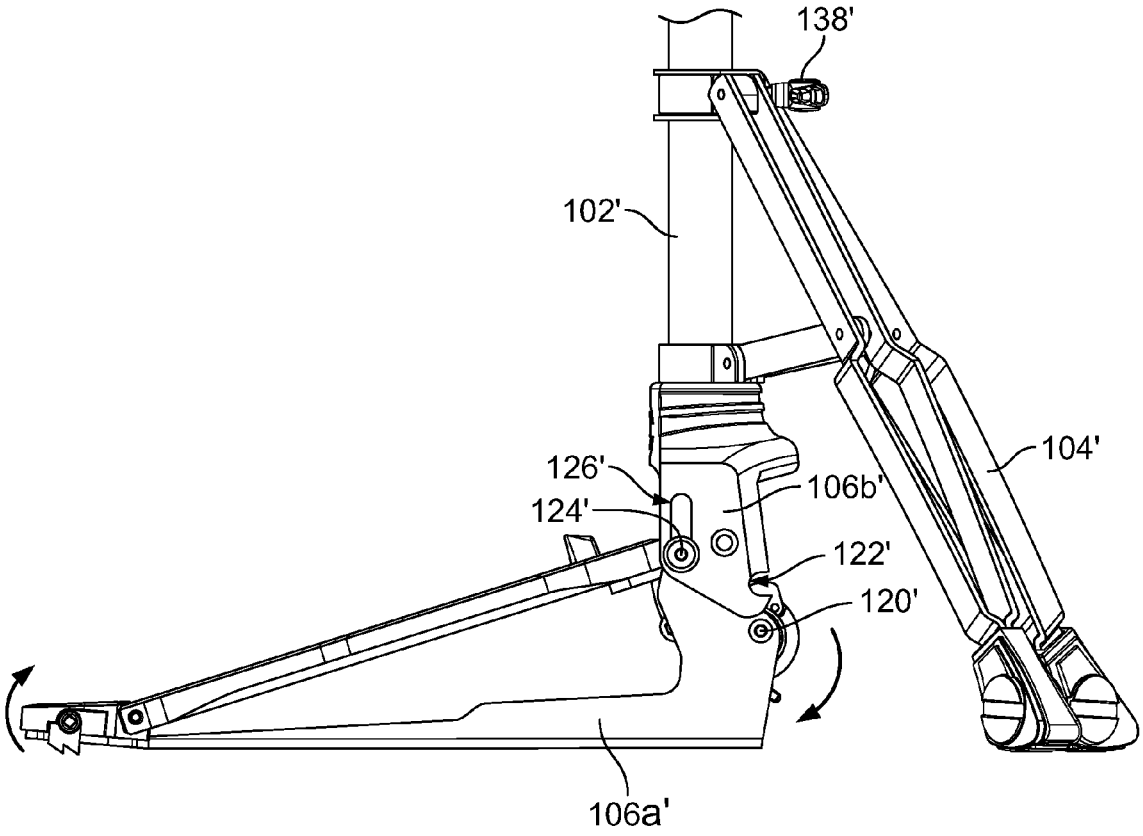
Figure 7D:
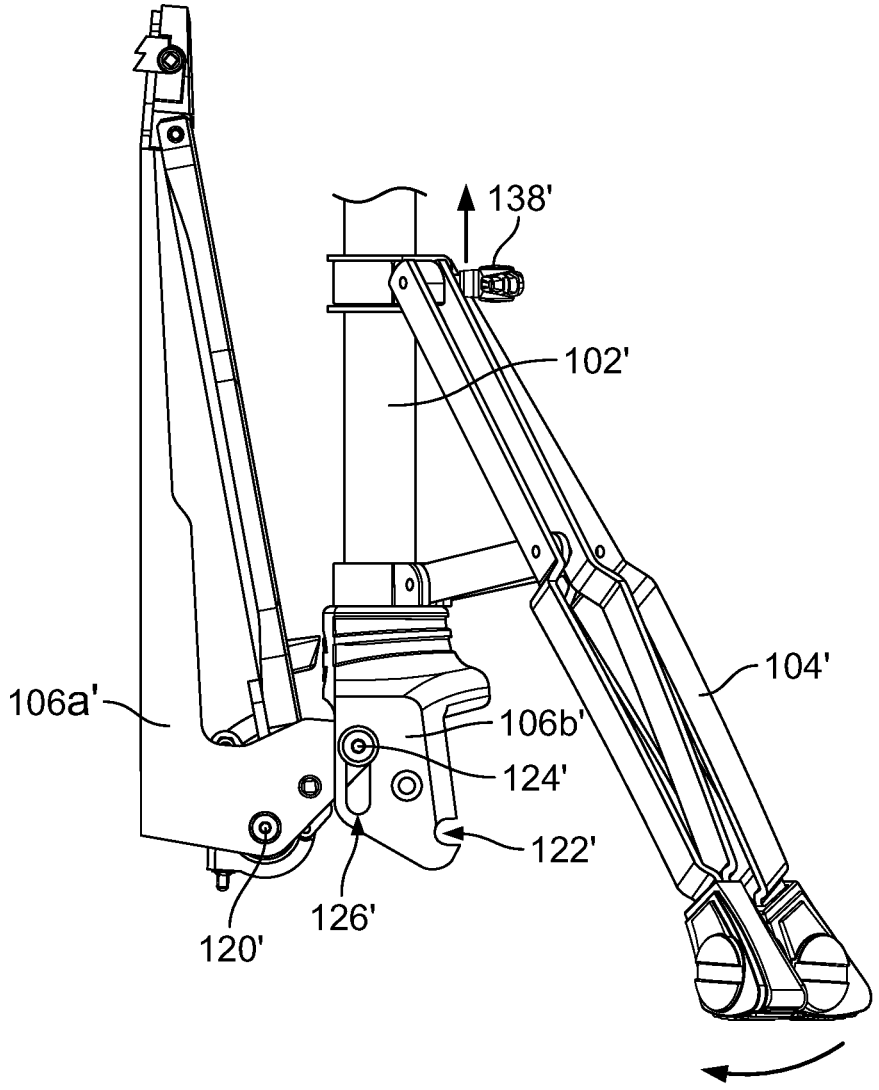
Figure 7E:
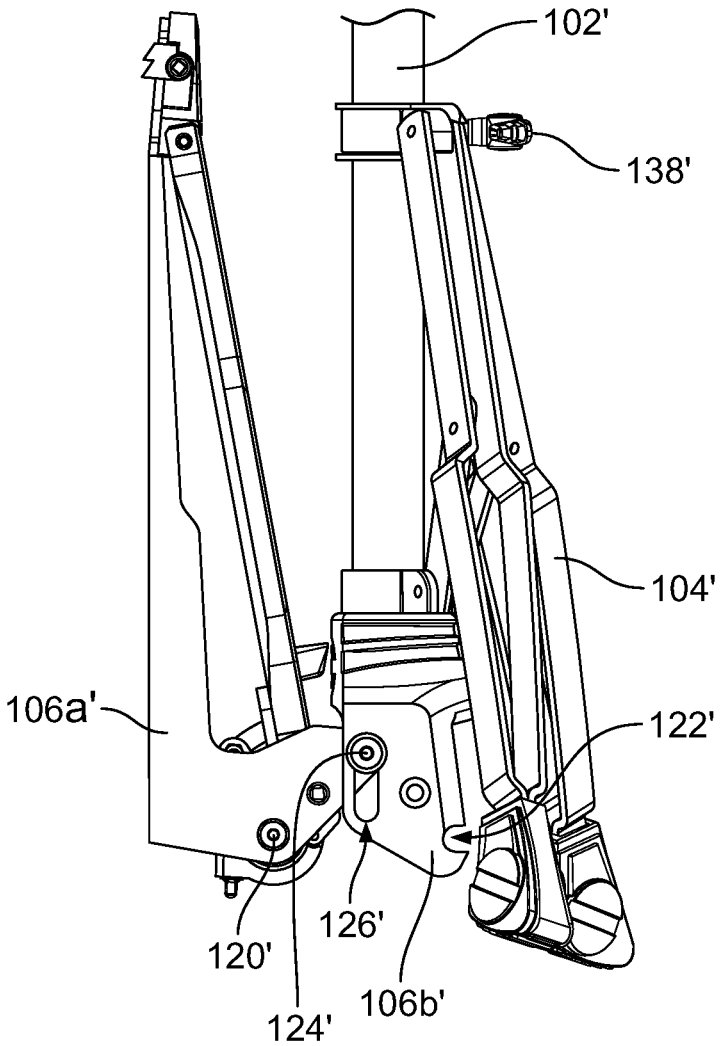

For transportation and/or storage, the foot pedal cymbal operating device 106' is pivotable in a plane transverse to the supporting floor surface between a first, extended, stand support position (shown in FIGS. 4-6) and a second, compact position, lying closely adjacent to the stand tube 102' (shown in FIG. 7E).

By arranging the foot pedal cymbal operating device 106' so that only the heel end 114' is disposed for contact with the supporting floor surface, a tripod-like arrangement is created to support the stand tube 102'. As a result, the stand 100' can be relatively more stable during use, including when a user depresses the foot pedal.

Referring to FIGS. 5 and 6, the foot pedal cymbal operating device 106' includes a moving pedal 128' operated to turn a rotor 130' that is pivotally fixed about a post 120' to a moving portion 106*a'* of the foot pedal cymbal operating device 106'. The moving pedal 128' is connected to the rotor 130' by a lever 132' so that when the moving pedal 128' is depressed (e.g., stepped on by a user), the rotor 130' rotates about the post 120'. The rotor 130' is connected (e.g., by a chain or a strap) to the vertically moving rod 108' so that as the rotor 130' rotates, the vertically moving rod 108' moves the upper cymbal 101*b'* to contact the lower cymbal 101*a'* and generate sound.

Referring to FIGS. 7A-7E, the legs 104' and the foot pedal cymbal operating device 106' are collapsible between extended support positions, where they form the supporting tripod arrangement, to compact stored positions to form a compact unit, e.g., for storage and/or transportation. The foot pedal cymbal operating device 106' includes one or more securement elements (e.g., fasteners) 118' that secure the foot pedal operating device 106' in a first, extended, stand support position by securing the moving portion 106*a'* to a stationary portion 106*b'*.

To collapse the foot pedal operating device 106' from the first, operating position to the second, compact position, the securement element 118' is removed (or displaced) and the moving portion 106*a'* is first moved downwardly away from the stand tube 102' to dislodge an alignment post 120' of the moving portion 106*a'* from a recess 122' of the stationary portion 106*b'*. As the post 120' is dislodged from the recess 122', the entire moving portion 106*a'* is moved downwardly while a pin 124' of the moving portion 106*a'* rides in a corresponding slot 126' of the stationary portion 106*b'*. The moving portion 106*a'*, along with the attached moving pedal 128' and rotor 130', are then pivoted away from the stand tube 102' in order to provide clearance for the post 120' from the stationary portion 106*b'* (referring to FIGS. 7A-7C).

Once the moving portion 106*a'* is translated downward so that the post can sufficiently clear the stationary portion 106*b'*, the moving portion 106*a'* can be pivoted upwardly towards stand tube 102' to lie closely adjacent to the stand tube 102' in the second, compact position (referring to FIGS. 7B-7D).

To collapse the legs 104', a leg clamp 138' is released so that the legs 104' can pivot with respect to stand tube 102'. Referring to FIGS. 7D-7E, the unsecured legs 104' can pivot towards the stand tube 102' as the leg clamp 138' moves upward along the stand tube 102'. Once the legs 104' are positioned closely to the stand tube 102', the leg clamp 138' can be re-tightened to secure the legs 104' in the second, stored position to form a compact unit for storage or transport.

In some implementations, the foot pedal cymbal operating device 106' includes a cleat 134' associated with the heel end 114'. The cleat 134' defines a gripping surface 136' that extends downwardly from the heel end 114' for engagement upon the supporting floor surface. The cleat 134' is rotatable between a first, deployed position, with the gripping surface in engagement with supporting surface (shown in FIG. 5), and a second, stowed position where the cleat 134' is removed from engagement upon the supporting floor surface. In some implementations, when in the second, stowed position, the cleat 134' is positioned within cavity of the heel end 114'.

A number of implementations have been described. For example, the stand tube 102', the legs 104', and the foot pedal cymbal operating device 106' can each be made of any of various suitable materials, e.g., plastic, composite, or metal. Also, the securement element 118' can include any suitable arrangement for securing the moving portion 106*a'* relative to the stationary portion 106*b*, e.g., the securement element 118' may be a threaded fastener.

It will be understood further that various modifications may be made without departing from the spirit and scope of the disclosure. Accordingly, other implementations are within the scope of the following claims.

What is claimed is:

1. A hi-hat musical cymbal set support stand, the stand comprising:

a vertical stand tube defining a stand axis, and three support members associated with a lower end of the stand tube and disposed in a tripod arrangement for supporting engagement of the stand upon a supporting surface, each supporting member defining a contact point with the supporting surface, the three supporting members supporting the lower end of the stand tube in a position spaced apart from the supporting floor surface, and at least one of the three supporting members comprising a foot pedal cymbal operating device having an outward heel end defining one of the three contact points and an inward toe end suspended from the lower end of the stand tube, the heel end being disposed in engagement with the supporting surface, and the toe end being spaced from contact with the supporting surface.

2. The stand according to claim 1, wherein two of the supporting members are leg members, the leg members being collapsible from a first, support position and a second, stored position, lying closely adjacent to the stand tube.

3. The stand according to claim 1, further comprising a cleat associated with the heel end and defining a gripping surface extending downward from the heel end for engagement upon the supporting surface, the cleat being rotatable between a first, deployed position, with the gripping surface in engagement with supporting surface, and a second, stowed position where the cleat is removed from engagement upon the supporting surface.

4. The stand according to claim 1, wherein the foot pedal cymbal operating device is pivotable in a plane transverse to the supporting floor surface between a first, extended, stand support position and a second, compact position, lying closely adjacent to the stand tube.

5. The stand according to claim 4, wherein the foot pedal cymbal operating device comprises a securement element operable to secure the foot pedal cymbal operating device in the first, extended stand support position.

6. The stand according to claim 1, wherein the three contact points define a stand contact plane, and the heel end contact point is spaced from the stand axis by a predetermined distance.

7. The stand according to claim 6, wherein the predetermine distance of the heel end contact point from the stand axis is at least 9 inches (22.9 cm).

8. The stand according to claim 1, wherein the foot pedal cymbal operating device, inward of the outward heel end, to and including the inward toe end, being spaced from direct supporting contact of the supporting surface.

* * * * *